United States Patent [19]

McNinch et al.

[11] 4,216,986

[45] Aug. 12, 1980

[54] RELEASABLE DOOR STOP ASSEMBLY

[75] Inventors: Delmar McNinch, Rock Falls; William K. Schuttler, Sterling, both of Ill.

[73] Assignee: Lawrence Brothers, Inc., Sterling, Ill.

[21] Appl. No.: 932,301

[22] Filed: Aug. 9, 1978

[51] Int. Cl.[2] ..... E05C 3/02

[52] U.S. Cl. ..... 292/341.17; 16/82; 292/341.18; 292/DIG. 61

[58] Field of Search ..... 292/219, 228, 341.15, 292/341.17, 341.18, DIG. 15, DIG. 53, DIG. 60, DIG. 61; 16/82, DIG. 10, DIG. 36; 70/DIG. 53, DIG. 69

[56] References Cited

U.S. PATENT DOCUMENTS

| | | | |
|---|---|---|---|
| 501,809 | 7/1893 | Riddelle | 292/DIG. 60 X |
| 1,120,538 | 12/1914 | Richardson | 292/341.17 X |
| 1,324,381 | 12/1919 | Bradshaw | 292/341.17 X |
| 1,485,382 | 3/1924 | Foley | 292/219 |
| 1,633,300 | 3/1928 | Halper | 292/341.17 |
| 2,107,687 | 2/1938 | Brown | 292/78 |
| 2,389,056 | 11/1945 | Jamison | 292/341.17 X |
| 2,889,571 | 6/1959 | Moore | 16/82 |
| 3,172,168 | 3/1965 | Snska | 292/219 X |
| 3,611,762 | 10/1971 | McBurnie et al. | 292/219 X |
| 3,656,787 | 4/1972 | Coopersmith | 202/DIG. 53 X |
| 3,805,322 | 4/1974 | Serrano | 292/DIG. 15 X |
| 3,862,774 | 1/1975 | Johnson | 292/228 |
| 3,946,460 | 3/1976 | Johnson | 292/341.17 X |
| 4,045,065 | 8/1977 | Johnson | 292/341.17 |

FOREIGN PATENT DOCUMENTS

| | | | |
|---|---|---|---|
| 388500 | 3/1933 | United Kingdom | 292/341.17 |

*Primary Examiner*—Thomas J. Holko

*Attorney, Agent, or Firm*—Trexler, Wolters, Bushnell & Fosse, Ltd.

[57] ABSTRACT

There is disclosed a releasable door stop assembly for a bidirectionally swinging door including a retractable stop member which normally permits opening of the door in one direction, thus acting as a stop against opening of said door in the opposite direction. The stop member is free floating and is spring biased, such that it can be retracted manually to permit opening of the door in the opposite direction. The biasing of the free floating stop member is effected by use of a leaf spring which localizes the applied force limiting same generally to the forward portions of the stop member. As such, upon manual depression, the rearward portion of the free floating stop member moves inwardly easily until a segment thereof bottoms, with the forward portion of said stop member then being rocked forward to retract the stop member entirely. The rocking movement serving to dispose an outer surface portion of the stop member at a level which precludes pinching of the operator's finger as the door passes the stop member. In addition, there is included a set screw adjustment means, whereby the initial position of the leaf spring may be varied, to accommodate tolerance variations in the spring shape.

5 Claims, 9 Drawing Figures

RELEASABLE DOOR STOP ASSEMBLY

BACKGROUND OF THE INVENTION

This invention relates generally to improvements in the structure of releasable stop assembly mechanisms for use with bidirectionally swinging doors, and particularly to a stop assembly mechanism constructed and arranged to provide an improved and unique type of compound operation or movement of the stop during depression.

To facilitate the disclosure, the stop assembly of this invention is illustrated and described herein in conjunction with doors in hospitals, nursing homes, and like areas. However, it should be understood that the present invention may find use in other application as well.

Heretofore, emergency release door stop assembly devices for bidirectionally swinging doors have been provided as shown for example in U.S. Pat. Nos. 2,889,571; 3,172,168; and 3,946,460. Generally speaking, these stop mechanisms are arranged to block movement of the door in other than the direction of normal opening, but can be selectively actuated, such that the door is released for opening in the opposite direction of its normaly use, for example during an emergency situation. This feature is particularly useful in hospitals, nursing homes, or the like where it may become necessary to rescue a patient who is behind a locked, inwardly opening door. In such situations, rapid rescue is generally desired, and thus taking the time to locate a suitable key or other release device for the lock mechanism is generally far less preferable than provision of a releasable stop for permitting the door to be opened in the opposite direction, i.e. outwardly. Also the use of such stops is less expensive than locks which include outside release mechanisms. Moreover, in many cases even though the lock may be released, opening of the door in its normal direction may be precluded as the patient may have collapsed in such a way as to block normal door movement.

The prior art emergency release door stops taught in the first two of the above-referenced patents generally include a stop element which was pivotally mounted and which protruded from the door frame so as to engage the edge of the door, limiting operation thereof to a first or normal direction. In order to open the door in an opposite direction, the stop element must be manually pivoted to a nonblocking position. In service, however, these pivotally mounted stops have proven disadvantageous from a number of standpoints. Initially, it should be recognized that such emergency use of the stop is relatively infrequent, such that the elements which provide the pivotal mounting tend to corrode or bind in place, resulting in the danger that they may malfunction when required. Moreover, in such places as hospitals, where these releasable stops are often used, washing of the doorways takes place relatively frequently, whereupon foreign materials such as soap, water, or other residue from washing may accumulate in the pivoting mechanism or the mechanism may rust or corrode thereby precluding proper operation thereof.

A further disadvantage of these prior art stops, was the difficulty of initially positioning the stop to provide a firm rattle-free disposition of the door, when the latching mechanism of the door was engaged. Even after proper initial installation in service, misalignment may later result from such factors as wear of the stop member or warping of the door, which could result in a door that rattled in the closed position.

The releasable door stop assembly disclosed in the latter of the above-referenced patents, U.S. Pat. No. 3,946,460 avoids these disadvantages. More specifically, in the embodiment therein disclosed, the pivotal mounted stop was replaced by a free floating, spring biased stop member. Further, the stop included an adjustably mounted abutment surface member which may be adjusted toward and away from the door, as necessary to assure both initial and continued proper alignment. While the releasable door stop structure as shown in said U.S. Pat. No. 3,946,460, has proven particularly reliable and effective in use, the present invention provides substantial improvements in this structure, primarily in the manner in which spring biasing is achieved which results in ease and safety of operation, as more fully described hereinbelow.

Accordingly, it is a general object of this invention to provide a new and improved releasable door stop assembly for bidirectionally swinging doors, and more specifically, to provide a releasable door stop assembly of the type described which is responsive to application of a surprisingly low amount of force for initiating its releasing action. Still another object of this invention is to provide an improved releasable door stop of the type described which when depressed, includes a surface which is substantially flush with the door frame, thereby eliminating any danger that the operator's fingers may be caught or pinched.

Briefly, the releasable door stop assembly of this invention includes a housing adapted to reside in the mortise of a door frame, and a stop member mounted for compound movement within the housing. A face plate includes an aperture through which a portion of the stop member normally protrudes. Biasing means in the form of a leaf spring, or the equivalent, which engages the free floating stop member initially only proximate a forward portion thereof. Accordingly, upon manual operation, little if any force opposes depression of the rearward portion of the stop member, which after being bottomed with respect to the housing, can be rocked forward against the biasing action of the spring to cause a surface segment of said stop to be disposed flush with the face plate, thereby permitting the door to swing past the stop without the danger of pinching the operator's fingers. The employment of a leaf spring mounted to the casing and separate from the stop, as opposed to the pair of coiled springs illustrated in U.S. Pat. No. 3,946,460 results in certain unexpected and surprising advantages. Due to the cantilevered nature of the spring and the long moment arm which results, the stop means is responsive to relatively small pressure or forces. Initially, the rear portion will move linearly inward, against little if any spring force, since the spring engages the forward section of the stop member. Subsequently, when the stop member is rocked forward, the spring force can easily be overcome due to the relatively long moment arm resulting from the fixed mounting of one end of the spring. As a further feature, the stop and the spring means are not interconnected, accordingly, the stop member is free to move or slide relative to the spring. Thus, when the stop is rocked forward, the spring force acting only on the forward portion, will produce relative movement of the stop rearwardly and upwardly, which positions the inclined or rear surface of the stop member at the proximate level of the face plate aperture to assure that the operator's fingers are not pinched as the door moves past the stop.

Other objects, features and advantages of the invention will be more fully appreciated upon consideration of the following detailed description of the invention and its mode of operation, together with the accompanying drawings.

DETAILED DESCRIPTION OF THE ILLUSTRATED EMBODIMENT

Figure 1:
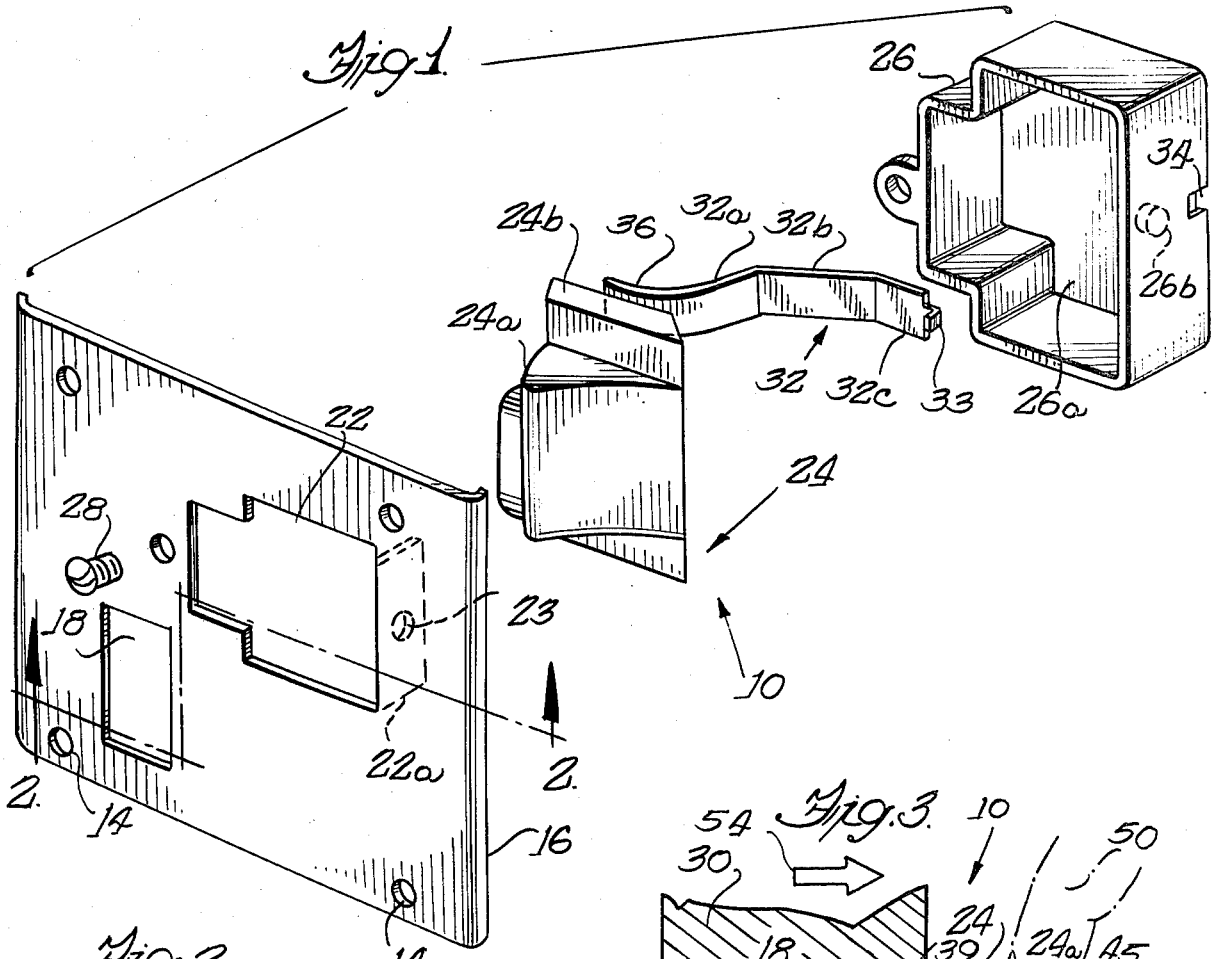
FIG. 1 is an exploded perspective view of a releasable door stop assembly according to the invention.
Figure 2:
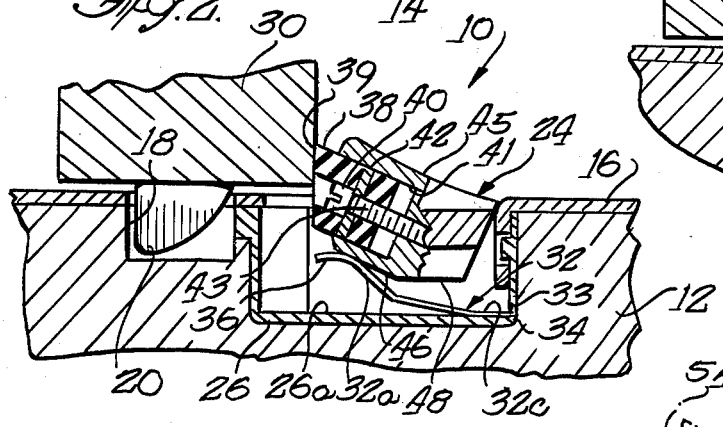
FIG. 2 is a sectional view, partially cut-away, illustrating the releasable door stop apparatus of the invention mounted in conjunction with a door frame and a door, said view taken generally along the line 2—2 of FIG. 1.

Referring now to the drawings, and initially to FIGS. 1 and 2, there is illustrated a door stop assembly constructed in accordance with the invention, and designated generally by the reference numeral 10. In this regard, it must be kept in mind that the door stop assembly 10 is adapted to be mounted to a door frame designated generally 12 by suitable screws or the like (not shown) fastened through apertures 14 about the periphery of a face plate 16. The door frame 12, is mortised as shown in FIG. 2, to accommodate the housing portion of the assembly 10.

In accordance with a preferred form of the invention, and a form similar to that illustrated in U.S. Pat. No. 3,946,460, the face plate 16 includes a strike aperture or opening 18 to receive a latch mechanism 20 when the door is closed, and a second opening or aperture 22 from which the stop member of the door stop assembly projects for restrictive engagement with the door 30. As is discussed in detail in said prior patent, and as will be briefly discussed hereinafter, the provision of a single face plate 16 having both a strike aperture 18 and a door stop aperture 22 in conjunction with an adjustable stop member, are particularly helpful features in insuring proper installation of the releasable door stop assembly 10 in proper alignment with the door latching mechanism 20. However, for purposes of the present invention, the face plate 16 may be provided with only the aperture 22, a door strike face plate and strike aperture 18 being provided separately.

Basically, the stop assembly 10 includes a stop member 24 which has a first portion 24*a* that normally protrudes or extends from the aperture 22, and a second or base portion 24*b* of somewhat larger dimension which is retained by the face plate 16 behind the aperture 22. This second or base portion 24*b* of the stop member 24 is retained within a housing 26 which is suitably affixed to face plate 16 by a screw 28 or the like. The face plate 16 also includes a struck out or bent over flange portion 22*a* which has an aperture 23 therethrough. Accordingly, the housing 26 may further be aligned and positioned with respect to the face plate 16 by engaging a protruberance 26*b* formed in a side wall thereof with the aperture 23.

As will be more fully described below, the stop member 24 is mounted for compound movement within the housing 26, so as to effect retraction of the first portion 24*a* below the surface of the aperture 22 to allow movement of a door 30 thereover. Toward this end, a biasing member, designated generally 32, is provided. In the assembled, initial condition, as illustrated in FIG. 2, the biasing or leaf spring member 32 urges the base member 24*b* of the stop member 24 into engagement with the portion of the plate 16 surrounding the periphery of the aperture 22, to effect normal protrusion of the first portion 24*a* for purposes of providing a stop for the door 30. In this regard, the stop member 24 includes a resilient bumper element 38 adjustably secured within a recess 41 and including a flat abutment surface 39 disposed generally parallel to the door 30 and against which the door 30 engages. This surface 39 is formed on a bias, so as to engage the door 30, in flush, face-to-face engagement for a purpose to be discussed more fully hereinafter.

Regarding the adjustable nature of the bumper 38, it should be noted that a screw element 40 is captively retained by the bumper 38 and is threadably engaged in a threaded recess in the stop member 24. A retainer ring 42 is carried by the bumper 38 and is engaged in a groove 43 formed adjacent the head of the screw 40, thus fixing the relative position of the screw 40 and the bumper 38. Operation of the screw 40 thus produces movement of the bumper 38 inwardly and outwardly relative to the stop member 24, thus permitting adjustment of the surface or face 39 thereof relative to the door 30. Accordingly, should the face 39 become somewhat worn in service or the door 30 become warped or otherwise misaligned therewith, the screw 40 may be readjusted to effect firm, rattle-free engagement with the door 30. Moreover, the adjustable feature of the bumper 38 aids in initial installation, whereby it is not necessary that precise positioning of the bumper 38 be effected initially, adjustment may be made to accommodate the requirements of the particular installation. The provision of the strike aperture 18 and the aperture 22 on the same face plate 16 further facilitates proper alignment of the abutment element 38 and in particular the surface 39 thereof for providing a snug, rattle-free engagement with the door 30, when the latch 20 is engaged within the strike aperture 18. This alignment may of course be achieved by the installer without the provision of the dual-apertured face plate 16.

In addition to the abutment surface 39 provided by the bumper 38, the stop member 24 also includes an outwardly disposed tapered surface 45. As can be seen from FIG. 2, the tapered surface 45 faces oppositely of the abutment surface 39, that is away from the door 30. Further, the stop member 24 includes a bottom surface portion which faces the inner wall 26*a* of the housing 26. This bottom surface is provided by a forward surface portion or segment 46 and a rearwardly disposed contiguous surface segment 48 disposed at an obtuse angle relative to the forward surface segment 46. The purpose for the respective surfaces 45, 46 and 48 will become clear from the discussion to follow concerning operation of the stop 10.

The biasing member or leaf spring 32 will be seen to lie interposed between the stop member 24 and the bottom surface 26*a* of the housing 26 when the assembly 10 is in its fully assembled condition as viewed in FIG. 2. The specific configuration of the leaf spring 32 will now be considered, in that the illustrated designs constitute a preferred form of the invention. More specifically, the leaf spring 32 includes three segments or sections designated generally 32*a*, 32*b* and 32*c*. A tab member 33 is formed at one end of the first end segment or section 32*c* and is engageable, as best viewed in FIG. 9, with a complementary slot 34 in a side surface of the housing 26, immediately adjacent a bottom surface 26*a* thereof to connect or anchor one end of the spring 32 to said housing. The intermediate segment 32*b* is formed at an obtuse angle with respect to the first end segment 32*c*, and similarly, the remaining, second end segment 32*a* formed at an obtuse angle with respect to the intermediate segment 32*b*. It should be noted that an end portion 36 of the second end segment 32*a* is formed to a curved or arcuate configuration.

In the initial condition as shown in FIG. 2, the curved portion 36 of the second end segment 32*a* is the only portion of the spring 32 which engages a bottom surface of the stop member 24. Specifically, it will be seen that the portion 36 of the spring 32 is normally (as viewed in FIG. 2) in engagement with the forward portion of the stop member 24 as generally defined by the surface 46. This area of engagement is generally below the bumper 38. It is important to note that this engagement between spring 32 and stop member 24 occurs only in the general area of the forward portion of stop 24 and urges or biases said stop 24 upwardly to hold the top surface of the base portion 24*b* against the face plate 16, as illustrated in FIG. 2. The rearward portion of the stop member 24, as generally defined by the surface 48, is not in engagement with the spring 42, and thus, is not biased in an upwardly direction.

Figure 3:
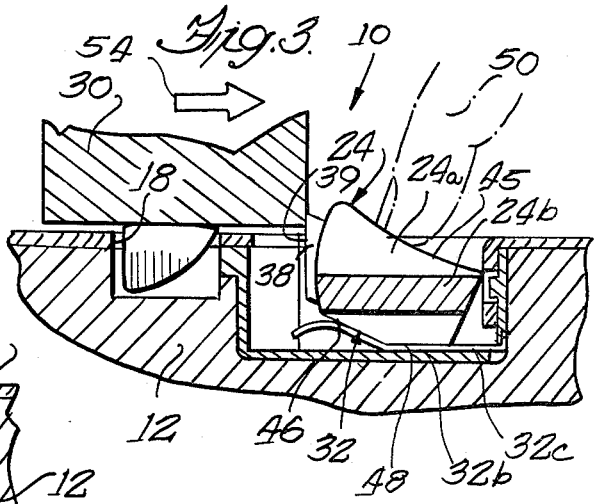
FIG. 3 is a sectional view, similar to FIG. 2, showing initiation of the compound movement of the stop member of the assembly upon manual depression.
Figure 4:
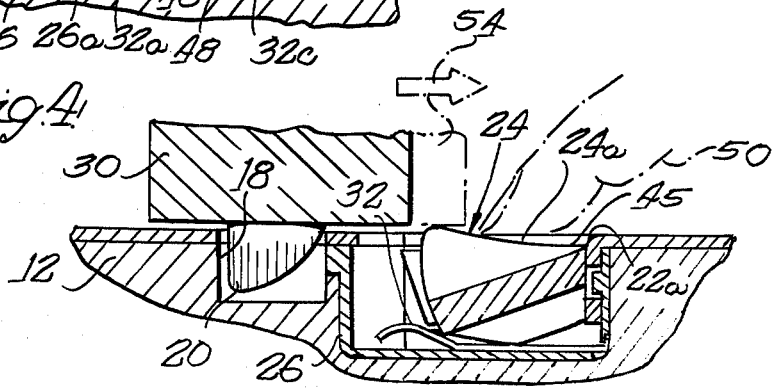
FIG. 4 is a sectional view similar to FIG. 3 showing completion of the compound movement initiated in FIG. 3.
Figure 5:
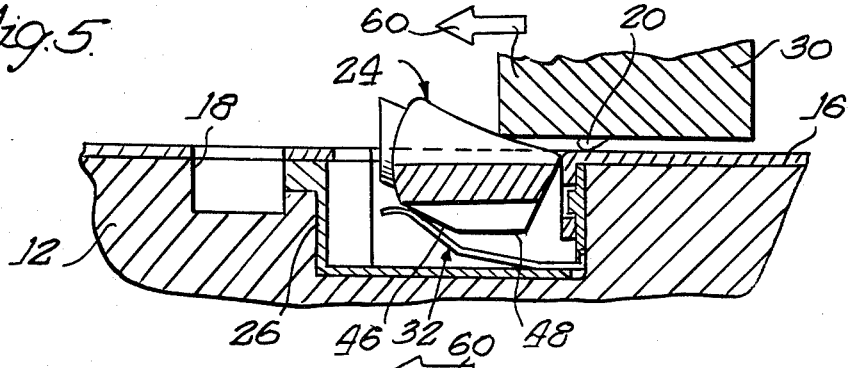
FIGS. 5 through 8 are sectional views similar to FIGS. 2 through 4, and illustrating the action of the releasable door stop assembly of the invention, upon the opened door being returned to its normal position.
Figure 6:
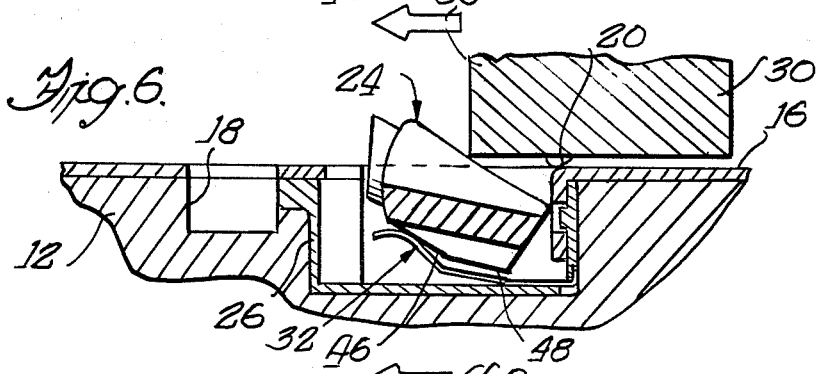

The operation of the stop 10 will now be considered, and attention is initially directed to FIGS. 3 and 4 wherein the compound movement of the stop member 24, which effects retraction thereof into the housing 26 is illustrated. Assuming an emergency situation necessitating that the door 30 be opened in the direction indicated by arrow 54, the operation will initially apply a force or pressure via finger 50, to the inclined surface. Since the spring 32 engages only the forward portion 46 of the stop member 24, the rearward portion thereof which is not subject to a direct biasing action will move inwardly easily, until the surface segment 48 bottoms with respect to the inner housing wall 26*a*, seating upon the segments 32*b* and 32*c* of the spring member which have also bottomed against the housing. It should be noted that the surface 39 of the bumper 38 is in flush, surface-to-surface contact with the door 30, said door being precluded from moving in a direction opposite to arrow 54 due to the engagement of the latch in strike aperture 18. Accordingly, the stop member 24 can only move linearly inward, viz., from the position shown in FIG. 2 to that as shown in FIG. 3.

Once the stop member 24 has bottomed, FIG. 3, with the surface 48 seated on the spring 32, the continued application of force to the inclined surface 45 will cause the stop member to rock forward to the condition of FIG. 4. Although the spring segments 32*b* and 32*c* are bottom against the housing, the second end segment 32*a* is not, being free to flex about its juncture with the intermediate section 32*b*, due to its obtuse relation with respect to said intermediate segment. As the stop member 24 rocks, the canted or obtuse end segment 32*a* will, due to its curved end 45 and the biasing force exerted upon the stop member 24, cause said stop member to slide rearwardly and upwardly, since the stop 24 and spring 32 are not interconnected. This compound movement, i.e. sliding rearwardly while being rocked forward, produces two important results; namely, the entire bumber 38 is recessed within the aperture 22, and the inclined surface 45 is moved upwardly to be disposed proximate aperture 22. The retraction of bumber 38 frees the door 30 to move in the direction 54, while the position of surface 45 insures that the finger 50 of the operator will not be pinched between the door 30 and the rear edge 22*a* of aperture 22 as the door is pulled past the stop 10.

As an additional feature, the edge portion of the face 39 of bumber 38 still engaging the door 30 in FIG. 3 offers some degree of resistance. Consequently, when the face 39 disengages from the door 30 a marked acceleration in the motion of the stop 24 is experienced, which causes a distinct click as the trailing edge of the surface 24*b* contacts or strikes the face plate 16. This provides a positive indication to the operator that the stop member 24 is recessed, and that the door may be opened. It will be appreciated that as the spring member 32 normally biases the stop member 24 upwardly by applying pressure only to the forward portion proximate the surface 46, as illustrated in FIG. 2, that a minimal amount of resistance is encountered in depressing the rearward portion of stop member 24 proximate surface 48. Accordingly, a surprisingly small amount of force in the direction opposing the urging force of the spring member 32 is sufficient to initiate the first stage or portion of the compound movement of the stop member 24. Further, during the second stage of said compound movement, the biasing action of spring 32 is utilized to assist in the sliding of the entire stop member 24 rearwardly as said member rocks forward. Thus, rather than having to overcome the biasing action, said action is harnessed to enhance the operation of the stop. With regard to the embodiment as illustrated in U.S. Pat. No. 3,946,460 wherein a pair of coiled springs are used, the utilization of the leaf spring 32 provides a surprising and unexpected reduction of the amount of force required to operate the stop, and also enhances the smoothness and effectiveness of the overall operation.

Figure 7:
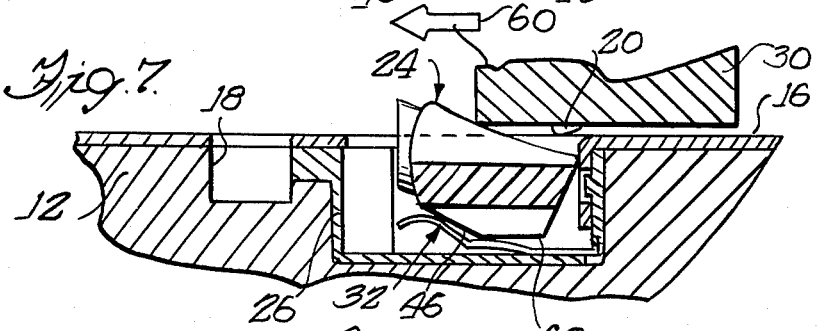
Figure 8:
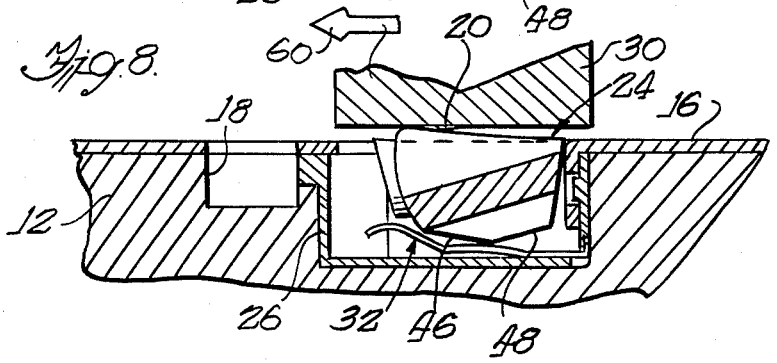

Resetting of the door 30 and stop member 24 is relatively simple, and is accomplished by a similar compound motion of the stop member 24. Reference to FIGS. 5 through 8 illustrate this resetting motion, which will now be briefly described. Initially referring to FIG. 5, it will be seen that upon initial engagement of the door 30 with the stop member 24, during its return motion indicated by arrow 60, that the position of the stop member 24 is substantially identical with that indicated in FIG. 2. However, once the leading edge of the door 30 engages the stop member 24 sufficiently to apply some degree of force thereto in opposition to the biasing force of spring 32, the rear portion of the stop member 24 will recede inwardly of the aperture 24 linearly, FIG. 6, similar to the action indicated and described above with reference to FIG. 3. However, as the door 30 does not press downwardly upon the stop element 24 to the same extent as the finger 50 of an operator, the stop member and spring 32 do not bottom in the housing 26. Referring now to FIGS. 7 and 8, with continued advancement of the door 30 in the direction indicated by the arrow 60, the stop member 24 continues to move inwardly, but since the bumper 38 is not confined against the door, the spring 32 will commence the sliding and rocking stages of the compound motion, much sooner than with the operation as described above during initial opening. It will be seen that this is due to the fact that the point of engagement between door 30 and stop member 24 is now generally vertically above the bottom surface 46 and the location of the biasing force provided by spring 32 thereof, rather than the bottom surface 48 as was true in FIG. 6 above. Finally, as indicated in FIG. 8, further advancement of the door 30 in the direction of the arrow 60 effects the continued sliding rocking of the stop element 24 and to effect a sufficient amount of recession or depression thereof within the housing 26 to allow passage of the door 30 thereover. It will be noted that the stop member 24 is not fully recessed in FIG. 8, with the spring 32 biasing said stop member outwardly. This fact due to the provision of the flush surface 39 on the bumper requires that the latch 20 pass the strike aperture 18, before the stop member 24 is fully reset.

Figure 9:
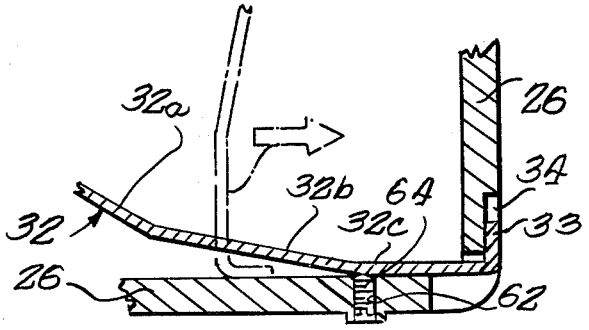
FIG. 9 is an enlarged sectional view illustrating further details of a preferred design for the leaf spring biasing means of the invention.

Attention is now directed to FIG. 9, wherein it will be recalled that there is illustrated one method of mounting the spring 32 to the housing 26. Briefly, the spring 26 includes an upturned end tab 33, that is engaged in housing slot 34. In order to obtain assembly, the spring 32 is positioned as shown in phantom and moved in the direction indicated until tab 33 is received in the lower portion of slot 34. The spring 32 is then pivoted in the counter-clockwise direction to the full line position, with section 32 resting on the inner wall 26*a*.

With the present invention, it is important that the spring 32 maintains the stop member 24 in the desired position, as shown in FIG. 4. Toward this end, the configuration of the spring 32, and more specifically the position of the arcuate end section 32*a* is extremely important. That is to say, due to the free floating nature of stop 24, if the spring end 32*a* is not at the proper height, the stop will not be properly positioned for engagement with the door 30. In practice, the manufacturing tolerances encountered with regard to mass produced springs are such, that it is important to provide for some form of adjustment for the leaf spring 32. Accordingly, the housing wall 26*a* may be provided with a threaded aperture 62 in which is disposed a set screw 64. The aperture 62 is positioned beneath the spring section 32*c*, against which the set screw 62 can be engaged. Accordingly, regardless of the tolerances encountered, the relative disposition of the spring 32 and accordingly the height of stop 24 can be adjusted as desired, by use of set screw 64. More specifically, as set screw 62 is advanced, it will cause the spring 32 to pivot upwardly, thus raising the end section 32*c* and correspondingly, the stop 24 which rests thereon.

Where a specific embodiment has been illustrated and described, the invention is not limited thereto, but includes such modifications, alternatives and changes as might be contemplated by those skilled in the art, insofar as they fall within the spirit and scope of the appended claims.

The invention is claimed as follows:

1. A releasable door stop assembly for use with a bi-directional swinging door, comprising in combination; a housing for insertion into a mortise formed in a doorway frame associated with said door, and said housing including an inner wall surface; a face plate adapted to be fastened to said doorway frame in registry with said housing, and including an aperture from which a stop member projects, a free floating stop member mounted for compound movement with respect to said housing and including a forwardly facing stop surface for engagement with a door, a rearwardly facing inclined surface, and a bottom surface; said bottom surface of the free floating stop member being provided by a generally forward planar segment and a contiguous, generally planar rearward segment disposed at an obtuse angle with respect to said forward segment, which planar segments serve to define generally forward and rearward portions of said stop member; and a leaf spring member disposed between said bottom surface and the inner wall of said housing, said leaf spring member biasing said stop member outwardly of said housing, and including, a first end portion which is fixed, and a second end portion having a curved end segment which engages the bottom surface of said stop member only proximate said forward portion, and an intermediate portion disposed between said first and second end portions and formed at an obtuse angle with respect to both said first and second end portions, said second end portion and said intermediate portion being of substantially equal length, such that upon engagement of said inclined surface to depress said free floating stop member, the intermediate portion of said spring will flex initially, about the juncture with said first end portion, and the rearward portion of said stop member will move inwardly easily without having to overcome the full resistance of said biasing force, such that when said rearward segment of the bottom surface of the stop member bottoms with respect to said housing, said intermediate portion of the leaf spring will also engage said housing, with the continued application of force to said inclined surface causing said stop member to rock forward against the action of said second end portion of said leaf spring member, with said second end portion, due to its substantial length, its curved end segment, and its obtuse relation with respect to said intermediate portion which provides a new point of flexture, forcing said stop member to move rearwardly and upwardly upon said rocking movement, thereby to dispose said inclined surface proximate said plate aperture, to preclude pinching of the operator's finger as the door moves past said stop member.

2. A releasable door stop assembly according to claim 1, wherein said face plate further includes a second aperture formed therethrough to receive a latch element of the door thereby providing a strike aperture.

3. A releasable door stop assembly according to claim 1, wherein said stop member includes a resilient bumper element having said stop surface for engagement with said door formed thereon, said bumper element being mounted to said stop element for selective movement toward or away from said door, and including means for maintaining a selected position, thereby said door can be maintained in firm engagement between said stop and a strike aperture, when in its closed condition.

4. A releasable door stop assembly, according to claim 1 further including selectively operable means for adjusting the position of said stop member.

5. A releasable door stop assembly according to claim 4 wherein said selectively operable means includes a set screw for engaging said biasing means.

* * * * *